US007761950B2

(12) United States Patent
Konishi et al.

(10) Patent No.: US 7,761,950 B2
(45) Date of Patent: Jul. 27, 2010

(54) WATER-DISINTEGRABLE CLEANING TOOL

(75) Inventors: Takayoshi Konishi, Kanonji (JP); Kazuya Okada, Kanonji (JP)

(73) Assignee: Unicharm Corporation, Ehime (JP)

( * ) Notice: Subject to any disclaimer, the term of this patent is extended or adjusted under 35 U.S.C. 154(b) by 1113 days.

(21) Appl. No.: 11/382,538

(22) Filed: May 10, 2006

(65) Prior Publication Data

US 2006/0254013 A1 Nov. 16, 2006

(30) Foreign Application Priority Data

May 13, 2005 (JP) ..... 2005-141298

(51) Int. Cl.
*A47K 11/10* (2006.01)
*A47L 13/16* (2006.01)

(52) U.S. Cl. ..... 15/210.1; 15/209.1; 15/226

(58) Field of Classification Search ..... 15/208, 15/209.1, 210.1, 223–226, 229.1, 229.2
See application file for complete search history.

(56) References Cited

U.S. PATENT DOCUMENTS 713,827 A * 11/1902 Winn ..... 15/226
1,047,703 A * 12/1912 Rapson ..... 15/229.1
1,683,538 A * 9/1928 Francois, Sr. ..... 15/226
2,572,178 A * 10/1951 Monroe et al. ..... 15/154
3,222,705 A * 12/1965 Peterka ..... 15/176.3
4,995,133 A * 2/1991 Newell ..... 15/229.1

FOREIGN PATENT DOCUMENTS

| | | |
|---|---|---|
| JP | 60162/1976 | 5/1976 |
| JP | 62-186833 A | 8/1987 |
| JP | 91470/1989 | 6/1989 |
| JP | 9-276194 | 10/1997 |
| JP | 2000-254060 | 9/2000 |
| JP | 3103299 | 8/2004 |
| JP | 3105217 | 10/2004 |

* cited by examiner

*Primary Examiner*—Mark Spisich
(74) *Attorney, Agent, or Firm*—Brinks Hofer Gilson & Lione

(57) ABSTRACT

A cleaning tool is formed by bundling a plurality of water-disintegrable cords to have a holding part in which the cords are joined to one another with a holding material wound therearound and bonded thereto by a water-soluble adhesive, and a cleaning part in which the cords are positioned independently from one another. Each cord is formed by twisting a water-disintegrable sheet such as a fiber entangled non-woven fabric of pulp fibers, rayon fibers, and the like entangled by water-jet processing.

10 Claims, 12 Drawing Sheets

FIG. 12A
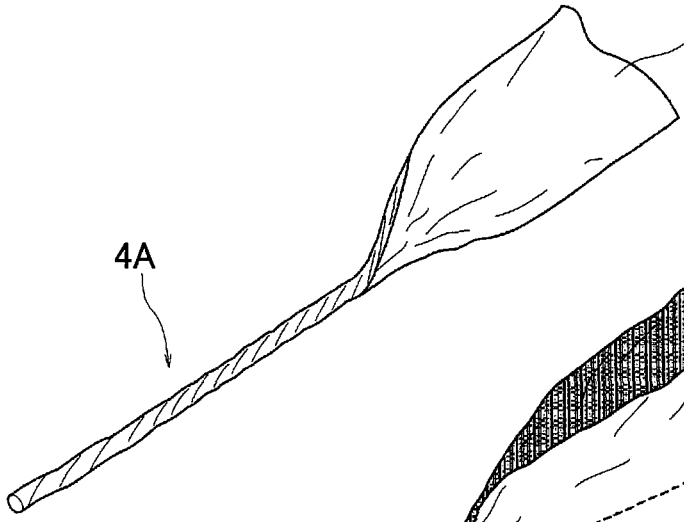
FIG. 12B
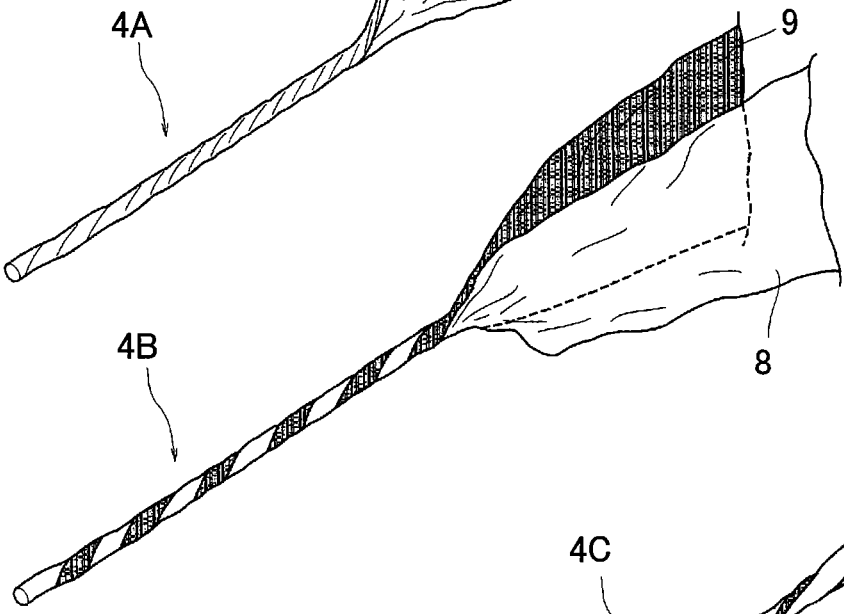
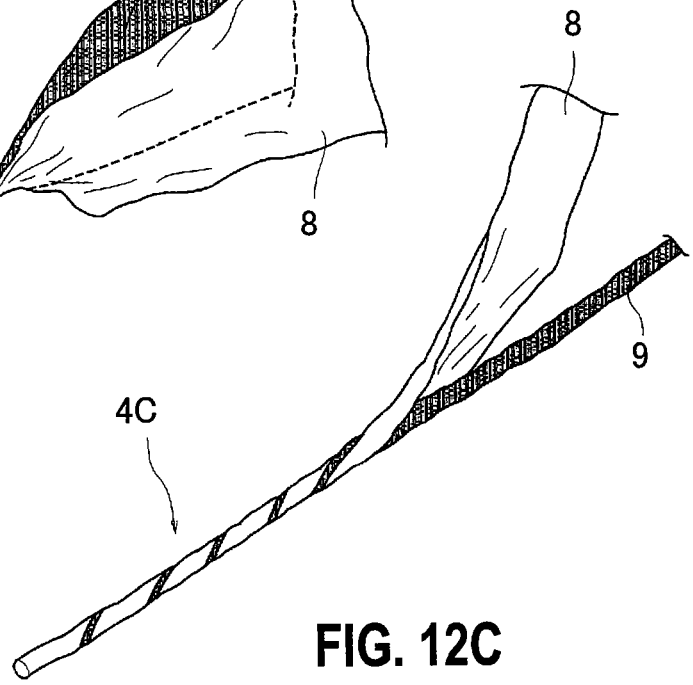
FIG. 12C

FIG. 13

| BLENDING | | EXAMPLE 1 | EXAMPLE 2 | EXAMPLE 3 | EXAMPLE 4 | EXAMPLE 5 | EXAMPLE 6 |
|---|---|---|---|---|---|---|---|
| PULP | NBKR | 95% | 90% | 50% | 10% | 5% | 50% |
| VISCOSE RAYON | 1.1dtex × 7mm | 5% | 10% | 50% | 90% | 95% | 50% |
| W.J.PROCESSING ENERGY/ONCE | $kW/m^2$ | 0.24682 | 0.24682 | 0.24682 | 0.24682 | 0.24682 | 0 |
| NUMBER OF W.J.PROCESSING | TIMES | 2 | 2 | 2 | 2 | 2 | 0 |
| PHYSICAL PROPERTIES OF WATER-DISINTEGRABLE SHEET | | | | | | | |
| FABRIC BASE WEIGHT | $g/m^2$ | 50.0 | 50.0 | 50.0 | 50.0 | 50.0 | 50.0 |
| THICKNESS | mm | 0.24 | 0.25 | 0.33 | 0.45 | 0.47 | 0.27 |
| DENSITY | $g/cm^3$ | 0.208 | 0.200 | 0.152 | 0.111 | 0.106 | 0.185 |
| DRY STRENGTH | N/25mm | 22.41 | 18.01 | 9.86 | 7.01 | 6.30 | 4.20 |
| WET STRENGTH | N/25mm | 0.81 | 1.04 | 2.43 | 5.35 | 6.02 | 0.68 |
| WATER-DISINTEGRABILITY (WATER DISINTEGRATION TIME) | SECONDS | 24 | 36 | 77 | 94 | 118 | 6 |
| PHYSICAL PROPERTIES AFTER TWISTING | | | | | | | |
| SHEET WIDTH | mm | 50 | 50 | 50 | 50 | | |
| NUMBER OF TWIST | TIMES/25cm | 17 | 17 | 17 | 17 | | |
| CORD WIDTH | mm | 2.0 | 2.2 | 3.5 | 4.0 | | |
| DENSITY | $g/cm^3$ | 0.796 | 0.658 | 0.260 | 0.199 | | |
| DRY STRENGTH | N | 82.96 | 66.96 | 45.42 | 25.83 | | |
| WET STRENGTH | N | 3.94 | 8.77 | 16.49 | 42.80 | | |
| WATER-DISINTEGRABILITY (WATER DISINTEGRATION TIME) | SECONDS | 30 | 60 | 83 | 123 | | |

FIG. 14

| BLENDING | | EXAMPLE A | EXAMPLE B | EXAMPLE C | EXAMPLE D | EXAMPLE E | EXAMPLE F |
|---|---|---|---|---|---|---|---|
| PULP | NBKR | 50% | | | | | |
| VISCOSE RAYON | 1.1dtex × 7mm | 50% | | | | | |
| W.J.PROCESSING ENERGY/ONCE | $kW/m^2$ | 0.24682 | 0.24682 | 0.24682 | 0.24682 | 0.24682 | 0.24682 |
| NUMBER OF W.J.PROCESSING | TIMES | 2 | 2 | 2 | 2 | 2 | 2 |
| PHYSICAL PROPERTIES OF WATER-DISINTEGRABLE SHEET | | | | | | | |
| FABRIC BASE WEIGHT | $g/m^2$ | 15.0 | 20.0 | 50.0 | 100.0 | 120.0 | 50.0 |
| THICKNESS | mm | 0.22 | 0.24 | 0.33 | 0.54 | 0.61 | 0.33 |
| DENSITY | $g/cm^3$ | 0.068 | 0.083 | 0.152 | 0.185 | 0.197 | 0.152 |
| DRY STRENGTH | N/25mm | 0.551 | 0.727 | 9.86 | 28.26 | 35.15 | 9.86 |
| WET STRENGTH | N/25mm | 0.194 | 0.341 | 2.43 | 7.46 | 9.33 | 2.43 |
| WATER-DISINTEGRABILITY (WATER DISINTEGRATION TIME) | SECONDS | 8 | 19 | 77 | 184 | 345 | 77 |
| PHYSICAL PROPERTIES AFTER TWISTING | | | | | | | |
| SHEET WIDTH | mm | 50 | 50 | 50 | 50 | 50 | 50 |
| NUMBER OF TWIST | TIMES/25cm | 18 | 18 | 17 | 16 | 16 | 4 |
| CORD WIDTH | mm | 2.8 | 2.9 | 3.5 | 4.6 | 5.0 | 5.0 |
| DENSITY | $g/cm^3$ | 0.122 | 0.151 | 0.260 | 0.301 | 0.306 | 0.127 |
| DRY STRENGTH | N | 1.87 | 2.41 | 45.42 | 84.78 | 108.9 | 10.11 |
| WET STRENGTH | N | 1.16 | 2.16 | 16.49 | 46.25 | 75.57 | 3.44 |
| WATER-DISINTEGRABILITY (WATER DISINTEGRATION TIME) | SECONDS | 22 | 41 | 83 | 276 | 643 | 80 |

WATER-DISINTEGRABLE CLEANING TOOL

This application claims the benefit of priority from Japanese Patent Application No. 2005-141298, filed on May 13, 2005, which is expressly incorporated herein by reference in its entirety.

BACKGROUND OF THE INVENTION

1. Field of the Invention

The present invention relates to a water-disintegrable cleaning tool for removing dirt in a place where water is used such as a flush toilet, which can be disposed in water after use.

2. Description of Related Art

Japanese patent application laid-open No. 62-186833 discloses the invention that relates to a disposable toilet cleaning brush for cleaning a flush toilet.

The toilet cleaning brush has a brush head formed of a paper made of short fibers as wood pulp and carboxymethyl cellulose (CMC) as a binder, wherein the paper has a plurality of cuts formed therein and is rolled to form the brush head. The toilet cleaning brush is attached to an end of a paper stick handle. After the toilet cleaning brush is used for wiping the toilet bowl, the toilet cleaning brush is disposed in a flush toilet together with the stick handle, and thereafter, both of which disintegrate in the water. Also disclosed there in is that a surface of the brush is subjected to wax treatment in order to adjust the time required for dissolving the paper.

The specification of the Japanese patent application laid-open No. 62-186833 describes that the time for cleaning the toilet bowl is so short that it requires only 10 to 20 seconds, and therefore the cleaning is completed before the paper constituting the toilet cleaning brush dissolves in the water.

However, being formed of the paper made of paper pulp bound with water-soluble CMC, the toilet cleaning brush starts swelling upon getting wet with water in cleaning the toilet bowl, and strength thereof becomes significantly reduced. Therefore, the dirt adhered to the toilet bowl is hardly wiped off. Also, due to the wax treatment which the brush is subjected to, the brush has a problem that a wax component thereof prevents disintegration of the paper, and therefore it requires a long time for the brush to disintegrate in the water in a water-purifier tank, etc.

In addition, being formed of a rolled paper having cuts formed therein, the toilet cleaning brush has a low rigidity which makes it difficult to rub the toilet bowl therewith and effectively remove the dirt adhered to the toilet bowl, etc.

SUMMARY OF THE INVENTION

The present invention is made in the light of the above-described problems. An object of the present invention is to provide a water-disintegrable cleaning tool capable of effectively wiping-off dirt and grime that adheres to a surface of a toilet bowl of a flush toilet, and the like.

Further, the object of the present invention is to provide the water-disintegrable cleaning tool having enough strength to rub a surface of the toilet bowl, etc, exhibiting an excellent dirt removing effect, while capable of being disintegrated in the water within a relatively short period after use.

An aspect of the present invention is a water-disintegrable cleaning tool, comprising a cleaning part formed of a plurality of cords each formed by twisting a strip of a water-disintegrable sheet; and a holding part which holds the cleaning part.

In the water-disintegrable cleaning tool of the present invention, the cords which are formed by twisting the strip of the water-disintegrable sheet are positioned in the cleaning part. The cords have high density and high rigidity with appropriate elasticity. Bundled cords have irregularities on the surface thereof providing a large surface area. Therefore, when the toilet bowl is rubbed by the cords, the dirt adhered to the surface of the toilet bowl and the like can be effectively removed, while maintaining the shape of the cleaning part. When the cleaning tool is disposed in water after use and given a great quantity of water, the twist of the cords is loosened to decrease the density thereof, and the cords are disintegrated in the water within a relatively short period.

In the present invention, it is preferable that the plurality of cords are fixed to one another in the holding part and positioned independently from one another in the cleaning part.

When the cords are positioned independently from one another in the cleaning part, the individual cord freely moves to slide on a surface to be cleaned such as in a toilet bowl, thus making it possible to clean corners in the toilet bowl.

Further, it is preferable that the holding part is releasably held by a holder.

By holding the holding part of the cleaning tool by the holder, the toilet bowl is wiped with the cleaning part. Thereafter, the cleaning tool is released from the holder and disposed in the flush toilet. Thus, the cleaning tool after use can be easily disposed without directly touching it. Since only the cleaning tool is disposed in the water and the holder is reused, the time required for disintegration in the water becomes shorter.

Further, it is preferable that each of the cords has its end positioned in the cleaning part. Alternatively, it is also preferable that each of the cords is bent to have its bent part positioned in the cleaning part When the cleaning tool with the bent cords is used, the bent parts of the cords come into elastic contact with the part to be cleaned. Therefore, the feel of pressing the cleaning tool against the part being cleaned is improved, and the effect of removing the dirt is enhanced. Also, even when the bent part of the cords gets wet, the twist of the cords is hardly loosened. Therefore, the wet strength of the cords can be maintained for relatively a long time.

The water-disintegrable sheet forming the cords is made of fibers having a fiber length of 20 mm or less, which can be dispersed in water when a large quantity of water is present. For example, the water-disintegrable sheet can be a sheet which is formed of only pulp fibers joined by hydrogen bonding force or by using a water-soluble binder. According to the present invention, the water-disintegrable sheet is preferably a fiber entangled nonwoven fabric in which fibers having fiber lengths of 20 mm or less are entangled.

The fiber entangled nonwoven fabric has a high strength in wet condition and is hardly broken when rubbing the part to be cleaned by the cords. Also, the fiber entangled nonwoven fabric is constituted by fibers having fiber lengths of 20 mm or less, and therefore when a large quantity of water is given thereto, the fibers can be dispersed separately in a relatively short period of time.

Alternately, according to the present invention, the cords are formed of the fiber entangled nonwoven fabric wherein the fibers having fiber lengths of 20 mm or less are entangled, and a water-disintegrable paper comprising cellulose-based fibers.

When the cords are formed by twisting the fiber entangled nonwoven fabric and the water-disintegrable paper together, the cords can be firmly and strongly twisted due to the hydrogen bonding force of the fibers of the water-disintegrable paper, and further a twisted shape thereof can be maintained while dry. In addition, when water is given and the paper is loosened, the strength of the cords can be maintained by a fiber entanglement of the nonwoven fabric.

For example, the fiber entangled nonwoven fabric of the present invention is constituted by entanglable pulp fibers and other fibers having fiber lengths of 20 mm or less, and contains 10 mass % to 90 mass % of the pulp fibers, and 10 mass % to 90 mass % of the other fibers. As an example of the aforementioned other fibers, rayon fiber is given.

The fiber entangled nonwoven fabric is so constituted that mainly other fibers having fiber lengths of 20 mm or less are entangled, and a shape of the cords is maintained while dry by the hydrogen bonding force of the pulp fibers. Therefore, the strongly twisted shape of the cords can be maintained while dry due to the hydrogen bonding force of the pulp fibers, while the cord can exhibit a proper surface strength by an entangling force of other fibers when the fabric gets wet by water. Further, when a large quantity of water is given thereto, dispersion of the pulp fibers is caused, resulting in easy dispersion of the fibers constituting the nonwoven fabric. In order to increase strength while dry, the fabric preferably contains 10 mass % or more of the pulp fibers, and in order to exhibit the strength by the fiber entanglement in wet condition, the fabric preferably contains 10 mass % or more of other fibers.

Further, according to the present invention, the cleaning part may include, in addition to the water-disintegrable cords, a water-disintegrable sheet member (sheet-shaped water-disintegrable material) and/or a water-disintegrable block member (block-shaped water-disintegrable material).

When the water-disintegrable sheet member or block member is used in conjunction with the water-disintegrable cords, the strength of the cleaning part is increased by these sheet member or block member, thus making it passible to strongly rub the cleaning part against the toilet bowl and so forth.

BRIEF DESCRIPTION OF THE DRAWINGS

The invention will now be described with reference to the accompanying drawings wherein:

FIG. 12A is an explanatory view showing one example of a structure of a twisted cord for forming cords.

FIG. 12B is an explanatory view showing the other example of a structure of a twisted cord for forming cords.

FIG. 12C is an explanatory view showing still other example of a structure of a twisted cord for forming cords.

FIG. 13 is a table showing physical properties of examples of water-disintegrable sheets and cords formed thereof of the present invention.

FIG. 14 is a table showing physical properties of other examples of water-disintegrable sheets and cords formed thereof of the present invention.

DETAILED DESCRIPTION OF THE PREFERRED EMBODIMENT

Figure 1:
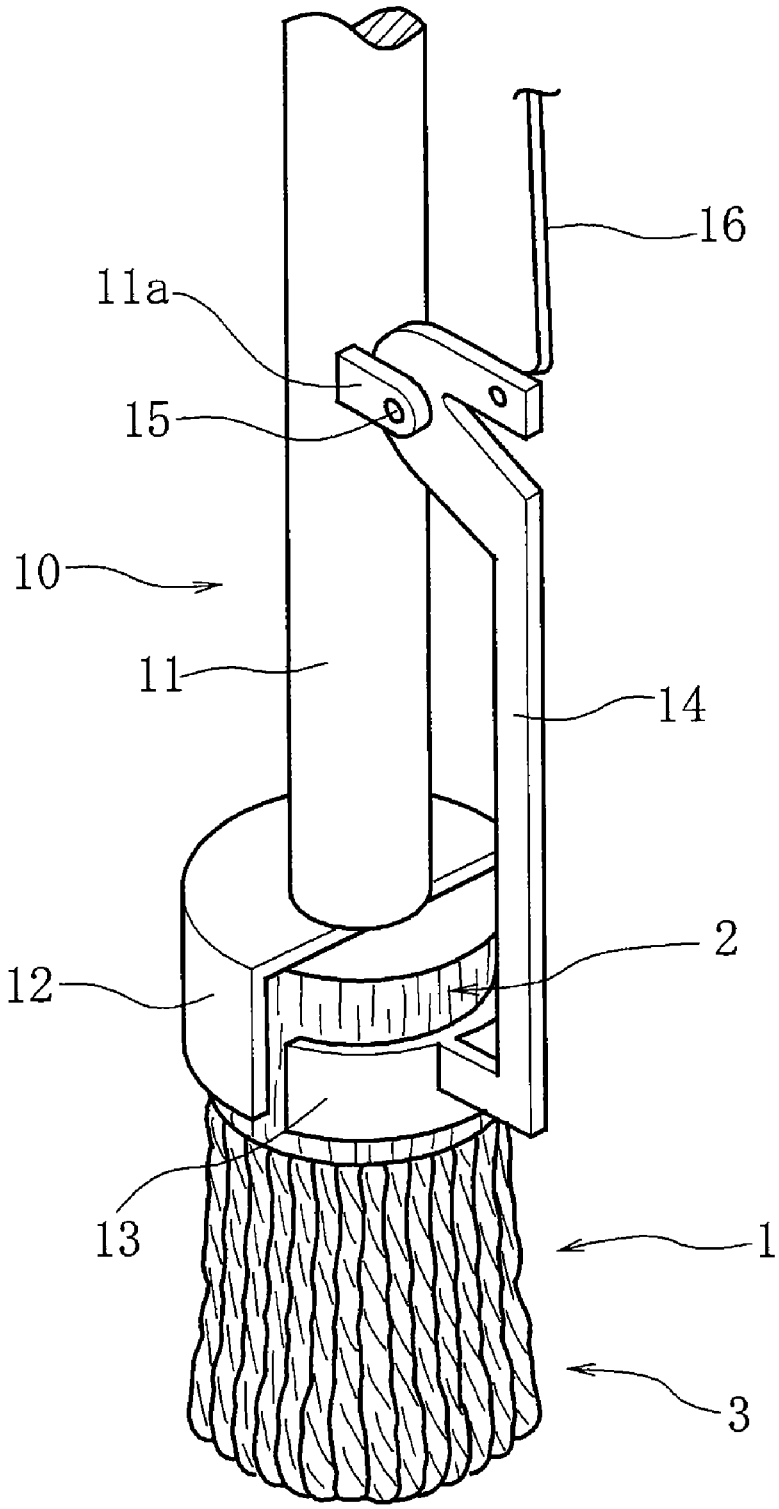
FIG. 1 is a perspective view showing a state in which a water-disintegrable cleaning tool of the present invention is held by a holder.

Embodiments of the present invention will be explained below with reference to the drawings, wherein like members are designated by like reference characters.

Figure 2:
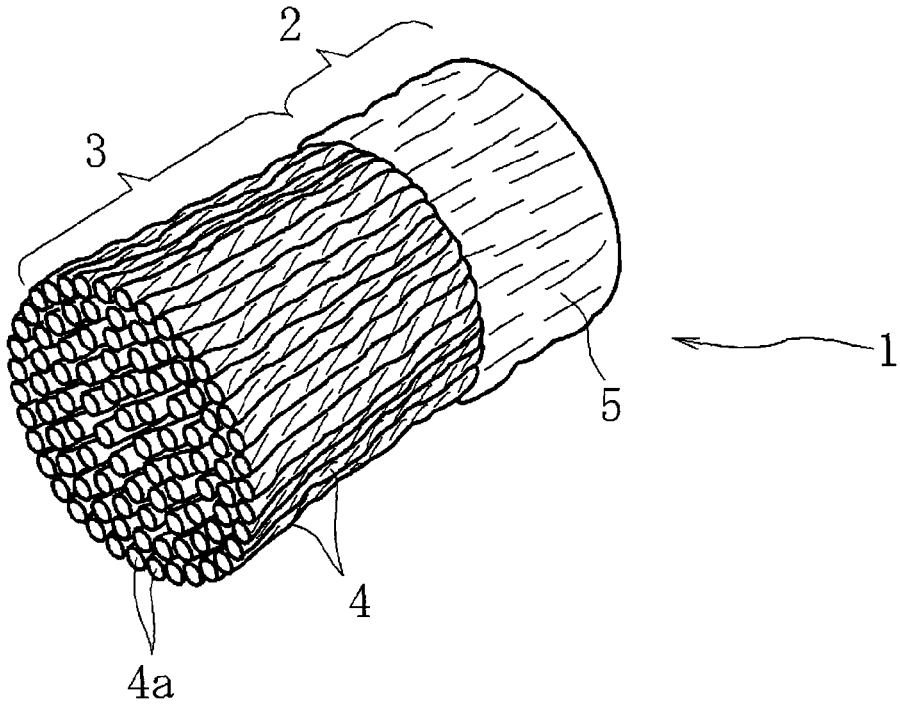
FIG. 2 is a perspective view showing a water-disintegrable cleaning tool according to a first embodiment of the present invention.

As shown in FIG. 1 and FIG. 2, a water-disintegrable cleaning tool 1 has a holding part 2 and a cleaning part 3. The holding part 2 has substantially a cylindrical shape.

A holder 10 shown in FIG. 1 comprises a synthetic resin handle part 11, a storage part 12 integrally formed at a tip part of the handle part 11, and a synthetic resin pressing part 13 provided on a position opposed to the storage part 12. On a side surface facing the pressing part 13 of the storage part 12, an inner peripheral surface constituting a part of a cylindrical surface having an axis almost parallel to an axial direction of the handle part 11 is formed. Also, on the side surface opposed to the storage part 12 of the pressing part 13, the inner peripheral surface constituting other part of the cylindrical surface formed by the inner peripheral surface of the storage part 12 is formed. Namely, the inner peripheral surfaces of the storage part 12 and the pressing part 13 face each other in a diameter direction of the cylindrical surface. A lever 14 extending from outside surface of the pressing part 13 in almost parallel with the handle part 11 is integrally formed with the pressing part 13. This lever 14 is rotatably supported on a bracket 11*a* formed in the handle part 11 through a pin 15. An operating wire 16 is rotatably connected to an upper end of the lever 14.

A torsion spring (not shown) is provided in the pin 15. The lever 14 is biased to rotate by the torsion spring with the pin 15 as a fulcrum, in a direction in which the pressing part 13 approaches the storage part 12. A handle is provided on an upper part of the handle part 11, and an operating lever is provided in this handle. The operating wire 16 is a thick wire, whose upper end is connected to the operating lever. When the operating lever is lifted, the operating wire 16 is also lifted relative to the handle part 11, and the lever 14 is rotated counterclockwise about the pin 15, and the pressing part 13 is moved away from the storage part 12. When holding the cleaning tool 1 by the holder 10, the pressing part 13 and the storage part 12 are held in a state separated from each other by lifting the operating lever, the holding part 2 of the cleaning tool 1 is inserted between the storage part 12 and the pressing part 13, and the operating lever is released. Then, by the biasing force of the torsion spring, the lever 14 is rotated clockwise, and the holding part 2 of the cleaning tool 1 is held by the storage part 12 and the pressing part 13 therebetween.

By rubbing the part to be cleaned of the toilet bowl and the like with the cleaning part 3 of the cleaning tool 1 held by the holder 10, the dirt adhered to the surface of the toilet bowl and the like can be removed. At this time, it is also possible to wipe-off the toilet bowl with the cleaning part 3 wetted by water in the toilet bowl. When a cleaning work is completed, by lifting the operating lever and removing a pressing force of the pressing part 13 against the cleaning tool 1, the cleaning tool 1 can be released to be disposed in the toilet bowl, without directly touching it.

As shown in FIG. 2, the cleaning tool 1 is constituted by bundling a plurality of cords 4. End faces 4*a* of cords 4 formed by cutting the cords 4 in section face toward the tip of the cleaning part 3, and the individual cords 4 of the cleaning part 3 are independent from one another without being mutually joined so that the individual cords 4 can break away from one another. Base parts of the individual cords 4 are bonded to one another by water-soluble adhesive in the holding part 2, and further a holding material 5 is wound around an outer peripheral surface of a bundle of the cords 4, and is bonded thereto by the water-soluble adhesive. Note that a cylindrical shape of the holding part 2 may be formed and maintained only by winding the holding material 5 around the bundle of the cords 4, without mutually bonding the cords 4 in the holding part 2.

As shown in FIG. 12A, each of the cords 4 is formed to have high density by twisting the water-disintegrable sheet in one direction. The water-disintegrable sheet is made of the fibers having fiber lengths of 20 mm or less, and when exposed to a large quantity of water in a flush toilet and in a water-purifier tank, fibers thereof are dispersed separately in a short period. The water-disintegrable sheet is a water-disintegrable paper made of only pulp fibers joined together by the hydrogen bonding force, or a water-disintegrable paper of the pulp fibers and rayon fibers joined together by the hydrogen bonding force. Alternately, a water-disintegrable paper in which the fibers are joined together by water-soluble binder such as polyvinyl alcohol (PVA) and polyacrylic acid (PAA), or carboxymethyl cellulose (CMD) and so forth can also be used.

The twist shape of the cord 4 is maintained by the hydrogen bonding force of the water-disintegrable paper, or the water-soluble binder can be added to the twisted water-disintegrable paper to thereby maintain the shape of the cords 4.

It is also possible to use the water-disintegrable sheet, wherein the pulp fibers are subjected to waterproof treatment to slightly lower hydrophilicity and are mutually joined by the water-soluble binder. The cords 4 formed of this water-disintegrable sheet can maintain the shape thereof even in wet condition during cleaning.

FIGS. 12A, 12B, and 12C show further preferable examples of twisted cords 4A, 4B, and 4C forming the cords 4. The cords 4 used in the cleaning tool 1 are constituted by any one of the twisted cords 4A, 4B, and 4C. Alternatively, two or more kinds of the twisted cords 4A, 4B, and 4C may be used in combination as the cords 4 of the cleaning tool 1.

FIG. 12A shows the twisted cords 4A which are formed by twisting in one direction a strip of a water-disintegrable sheet 8 of a predetermined width.

In order to maintain the strength of the twisted cords 4A when wet, the water-disintegrable sheet 8 is formed as a water-disintegrable fiber entangled nonwoven fabric. The fiber entangled nonwoven fabric can be formed by laminating entanglable fibers having fiber lengths of 20 mm or less on a conveyor of a mesh-like perforated screen, and entangling the fibers by water-jet processing.

For example, the fiber entangled nonwoven fabric is constituted by pulp fibers and fibers having fiber lengths of 20 mm or less, which can be entangled by the water-jet processing. When the nonwoven fabric is constituted by the pulp fibers and other fibers having fiber lengths of 20 mm or less, the aforementioned other fibers are entangled by the water-jet processing, and hydrogen bonding are formed between the pulp fibers and between the pulp fiber and the aforementioned other fibers. The fiber entangled nonwoven fabric thus formed is capable of maintaining the strength when dry and also maintaining the twisted shape by the hydrogen bonding of the pulp fibers. Also, the fiber entangled nonwoven fabric is capable of maintaining its high surface strength when wet by the entangling force of the aforementioned entanglable other fibers having fiber lengths of 20 mm or less. When disposed in the water and given a large quantity of water, the twist of the cord is loosened by disintegration of pulp fibers, having the entanglement of other fibers loosened. Therefore, the fibers are broken into pieces in relatively a short period.

As the other fibers having fiber lengths of 20 mm or less which can be entangled by the water-jet processing, it is preferable to use biodegradable fibers. It is also preferable to use a regenerated cellulose fiber such as viscose rayon, solvent spun rayon, polynosic rayon, cuprammonium rayon, and alginate rayon. As other fibers having fiber lengths of 20 mm or less which can be entangled by the water-jet processing, polyethylene terephthalate (PET), nylon fiber, and polypropylene (PP) fiber can be used.

Also, in addition to the pulp fibers, or instead of the pulp fibers, natural fibers such as hemp and cotton, and other natural fibers such as bagasse, banana, pineapple, bamboo, and so forth may be used.

Further, the strength of the water-disintegrable sheet 8 may be increased by adding polyvinyl alcohol (PVA) fiber as water-soluble resin, and water-soluble or water swellable carboxymethyl cellulose (CMC) as a binder. Alternately, a fiber entangled nonwoven fabric which is made by a wet papermaking process and the water-jet processing thereafter of the fiber having fiber lengths of 20 mm or less and a fibrillated rayon made by beating rayon having fiber lengths of about 3 to 7 mm to have on the surface thereof a plurality of micro fibers having fiber lengths of 1 mm or less peeled off, can be used. In the nonwoven fabric, the fibers having fiber lengths of 20 mm or less are entangled, and the fibers are bound together by the hydrogen bonding force of the fibrillated rayon. Therefore, the strength thereof in a dry state and in a wet state is enhanced, and the strength when dry is particularly increased. This contributes to maintaining a tightly twisted shape of the cords 4.

Preferably, the fiber entangled nonwoven fabric of which the twisted cords 4A are formed, contains 10 mass % or more of natural fibers such as pulp fibers, and contains 10 mass % or more of other fibers having fiber lengths of 20 mm or less which can be entangled by water-jet processing like rayon fibers. By containing 10 mass % or more of natural fibers, the hydrogen bonding force can be increased to thereby enable tightly twisting the fabric for forming the twisted cord. Also, by containing 10 mass % or more of the other fibers, the strength at the time of getting wet can be enhanced.

The disintegrable sheet 8 made of the fiber entangled nonwoven fabric preferably has a fabric base weight of 30 g/m$^2$ or more and 120 g/m$^2$ or less, and preferably a thickness of a sheet of 0.1 mm or more and 0.5 mm or less.

Further, after forming the cords 4A by twisting the water-disintegrable sheet, the above-mentioned binder may be coated thereon to maintain the shape of the twisted cords 4A.

In FIG. 12A, the twisted cords 4A are formed by using a sheet of the water-disintegrable sheet 8 which is the fiber entangled nonwoven fabric. However, the twisted cord may be formed by twisting a plurality of water-disintegrable sheets 8 stacked on one another. In order to increase the strength at the time of cleaning by increasing the thickness of the individual cord 4 used in the cleaning tool 1 shown in FIG. 2, the fabric base weight and thickness of one sheet of the water-disintegrable sheet 8 may be increased. However, when the fabric base weight and thickness of one sheet of the water-disintegrable sheet 8 are excessively increased, the twisting process thereof becomes difficult with the time required for water disintegration of the water-disintegrable sheet 8 increased. When the twisted cords 4A are formed by using plural sheets of the water-disintegrable sheets 8, the twisted cords can be thick, having high rigidity. In addition, when the twist of the cord 4 is loosened by exposure to a large quantity of water, the twisted cords 4A are separated into individual water-disintegrable sheets 8, and become easy to be disintegrated in the water.

The twisted cords 4B shown in FIG. 12B are formed by stacking the water-disintegrable sheet 8 which is the fiber entangled nonwoven fabric, and the water-disintegrable paper 9, and twisting both of the water-disintegrable sheet 8 and the water-disintegrable paper 9 together at the same time. The water-disintegrable paper 9 is made by papermaking or forming on a screen a layer of the natural fibers such as pulp fibers, or the regenerated cellulose fibers such as rayon fibers. The water-disintegrable paper 9 thus made exhibits the strength deriving from the hydrogen bonding force of the fibers.

When the water-disintegrable sheet 8 and the water-disintegrable paper 9 are stacked on each other and twisted together at the same time, since the water-disintegrable sheet 8 which is the fiber entangled nonwoven fabric has greater strength, a tight twist of the cord 4B can be obtained. The shape of the twisted cord 4B can be maintained at the time of drying by the hydrogen bonding force of the fibers constituting the water-disintegrable paper 9. Therefore, the twisted cords 4B can have high density and the shape thereof can be maintained. In the case the cords 4 of the cleaning tool 1 are formed of the twisted cords 4B having high density as shown in FIG. 2, even when a small quantity of water soaks thereinto, the dirt adhered to the surface of the toilet bowl, etc, can be removed by the cords 4 having high rigidity. Also, when disposed in the flush toilet, etc, with a large quantity of water being given thereto, the fibers constituting the water-disintegrable paper 9 are loosened, thereby loosening the twisted water-disintegrable sheet 8.

When the water-disintegrable sheet 8 and the water-disintegrable paper 9 are stacked on each other and twisted together at the same time, a plurality of irregularities are formed on the surface of the twisted cords 4B, thus increasing the effect of removing the dirt. In addition, the twisted cords 4B may be constituted by using at least one of the plural sheets of the water-disintegrable sheet 8 and water-disintegrable paper 9.

In the twisted cords 4B shown in FIG. 12B, the water-disintegrable paper 9 is colored in a color other than white such as blue or red. The water-disintegrable sheet 8, which is the fiber entangled nonwoven fabric, is formed of white fibers. By twisting the water-disintegrable sheet 8 and the water-disintegrable paper 9 together, a colored part and a white part are alternately positioned, giving a good appearance. In addition, it becomes easy to perceive a twisted state of the twisted cords 4B.

When the twisted cords 4B of FIG. 12B are manufactured, an air-laid nonwoven fabric can be used instead of the water-disintegrable paper 9. The air-laid nonwoven fabric is formed by laminating the pulp fibers by an air-laid method to form a fiber web, and bonding the fibers with a water-soluble binder such as PVA. The air-laid nonwoven fabric has a low fiber density of about 0.04 to 0.700 g/cm$^3$ and is made bulky having thickness of about 0.3 to 5 mm, and can be disintegrated in the water in a short period. The air-laid nonwoven fabric has a cushioning property, and therefore by twisting the air-laid nonwoven fabric and the water-disintegrable sheet 8 which is the fiber entangled nonwoven fabric together, the twisted cords having elasticity can be obtained.

The cords 4C shown in FIG. 12C are formed by twisting a sheet of water-disintegrable paper 9 or plural sheets thereof, or the air-laid nonwoven fabric, or by stacking the water-disintegrable paper 9 on the air-laid nonwoven fabric and twisting both of them together to form a core part, and thereafter by further twisting them while winding the water-disintegrable sheet 8, which is the fiber entangled nonwoven fabric, around the core part. Owing to a high hydrogen bonding force, the core part of the twisted cord 4C can maintain the twisted state thereof and have high density. Since the water-disintegrable sheet 8 having high wet strength is wound around the core part, the surface strength of the cords 4 can be increased, and the shape of the cords 4 can be maintained when wiping-off is performed in a wet state. Also, when a large quantity of water is given thereto, the water-disintegrable paper 9 or the air-laid nonwoven fabric constituting the core part is disintegrated, loosening the twist of the water-disintegrable sheet 8, whereby the cords 4 can be disintegrated in the water in a short period of time.

The number of twists of the twisted cords 4A, 4B, and 4C is preferably 4 to 30 times per unit length of 250 mm of the twisted cords. When the number of twists is fewer than the aforementioned number, the density of the cords is decreased, and the cords become easy to break and cannot withstand a frictional force during wiping work. Meanwhile, when the number of twists is beyond the aforementioned number, an excess load is applied to a sheet during the twisting process, posing a possibility of breakage of the cord. The thickness of the twisted cords 4A, 4B, and 4C is preferably 1 to 10 mm. This range gives a tactile feel when wiping is performed with the cords 4, while eliminating the possibility of piping clogging when the cleaning tool is disposed in the flush toilet or the like.

The cords 4 constituting the cleaning tool 1 shown in FIG. 2 are formed by cutting at least one of the twisted cords 4A, 4B, and 4C into lengths of 30 to 100 mm, for example, and bundling about 5 to 50 cords having the same lengths. Base parts of the cords 4 are bonded by water-soluble adhesive such as PVA with the cut end faces 4*a* thereof aligned, and a water-disintegrable holding material 5 is wound around an outer circumference of a bundle of the cords 4 and bonded thereto by the water-soluble adhesive. Specifically, in the holding part 2, the cords are mutually bonded and the water-disintegrable holding material 5 is wound around the cords 4, and in the cleaning part 3, individual cords 4 are positioned independently from one another.

The holding part 2 of the cleaning tool 1 is held by the storage part 12 and the pressing part 13 of the holder 10 shown in FIG. 1 when being in use. Therefore, even if the holding part 2 gets wet with water during cleaning work, the separation of the cords 4 in the holding part 2 can be prevented by being held between the storage part 12 and the pressing part 13 of the holder 10. Accordingly, it is sufficient for the holding part 2 to have, in a dry state thereof before being held by the holder 10, a fixing force not allowing the cords 4 thereof to be separated. Therefore, the holding material 5 to be wound around the holding part 2 can be made of the same paper material as that of the water-disintegrable paper 9, or a water-disintegrable film such as a PVA film. Alternately, the holding part 2 may be the one in which the hydrogen bonding force of the cords 4 is increased by bundling and compressing, or heating and compressing the cords 4.

Further, the cords 4 in the cleaning part 3 may be mutually bonded by the water-soluble adhesive or the hydrogen bonding force. In this case, when wiping the toilet bowl, etc, with the cleaning part 3, and moisture is given to the cleaning part 3, the cords 4 therein becomes independently separated from each other, and the wiping is performed by the separated individual cords 4.

In the case where the fixing force of the cords 4 in the holding part 2 is set low, the time required for the cords 4 in the holding part 2 to be separated from each other becomes shorter than the time required for disintegrating the cords 4 themselves. When the cleaning tool 1 is disposed in the flush toilet and the like, and a large quantity of water is given thereto, a bonding force of the cords 4 in the holding part 2 first disappears, whereby the cords 4 are quickly separated from one another. This makes it possible to disintegrate the individual cord 4 thereafter in the water in a short period.

The water disintegration time of the individual cord 4 is preferably 700 seconds or less, or further preferably 600 seconds or less, or still further preferably 300 seconds or less, per one cord 4 of a length of 100 mm when the time is measured pursuant to JIS P4501 (toilet paper releasability test). The measurement was performed as follows. 300 milliliter of ion exchange water having water temperature of 20±5° C. was put in a beaker having a volume of 300 milliliter, and the cords 4 were put in the ion exchange water, then, a stirrer was rotated at a revolution number of 600 rpm in the water to stir the cords together with the ion exchange water. The measurement is performed from the time when the cords 4 were put in the ion exchange water till the time when the shape of the cords disappear with no sheet-like shape left and the fibers of the cords are dispersed into the water.

Next, a method of using the cleaning tool 1 will be explained.

The holding part 2 of the cleaning tool 1 shown in FIG. 2 is held between the storage part 12 and the pressing part 13 of the holder 10 shown in FIG. 1, and the inside of the toilet bowl of the flush toilet is cleaned, being rubbed with the cleaning part 3. When wiping-off the inside of the toilet bowl, the cleaning part 3 can be wetted by water in the flush toilet, to thereby remove the dirt effectively. The cords 4 are formed by twisting the water-disintegrable sheet 8, or by twisting the water-disintegrable sheet 8 and the water-disintegrable paper 9 together, and have high density of fibers, high rigidity, and elasticity. Further, irregularities are formed on the surface of the cords 4. Therefore, the dirt adhered to the toilet bowl can be further effectively removed. Particularly, when the cords 4 are constituted by the fiber entangled nonwoven fabric, the surface strength thereof is increased and the cords 4 are free of fraying/damage during cleaning, thereby making it easy to maintain the shape of the cords 4. The cleaning part 3 is formed of plural cords 4, and the individual cord 4 moves independently on the surface of the part to be cleaned, while the cords 4 of the cleaning part 3 are spread over the surface of the part to be cleaned by a pressure applied thereto during cleaning. This makes it easy to clean every corner of the toilet bowl.

After cleaning the toilet bowl, when the pressing part 13 is released from the storage part 12, the cleaning tool 1 drops into the water of the flush toilet and can be flushed with cleaning water. Since the fixing force of the holding part 2 disappears in the water and the cords 4 are separated into individual cords 4, the cords 4 can be flushed without causing the piping to be clogged. Then, the cords 4 are disintegrated in the piping or water-purifier tank into separated fibers.

FIGS. 3-11 are perspective views showing the cleaning tool of other embodiments of the present invention.

Figure 3:
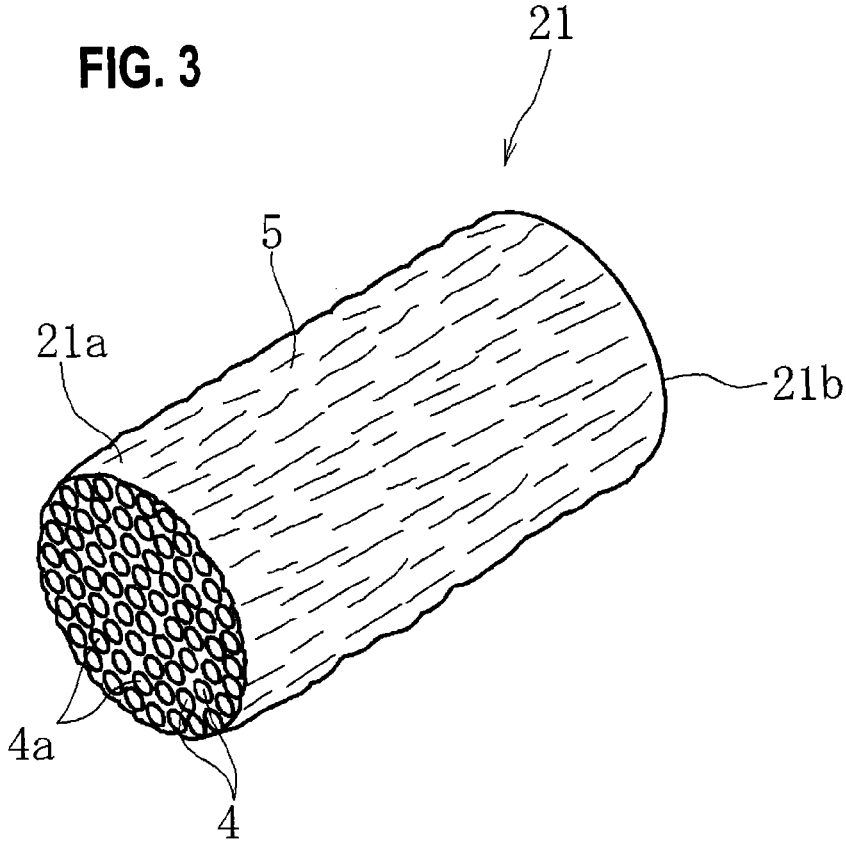
FIG. 3 is a perspective view showing a water-disintegrable cleaning tool according to a second embodiment of the present invention.

FIG. 3 shows a water-disintegrable cleaning tool 21 of a second embodiment of the present invention.

In this cleaning tool 21, the cords 4 of predetermined lengths are bundled, and the water-disintegrable holding material 5 is wound therearound over the whole lengths of the bundle, with the inner side thereof bonded to the plurality of cords 4 by the water-soluble adhesive. Either end part 21*a* or end part 21*b* of the cleaning tool 21 can be used as the holding part, and the rest of the end parts can be used as the cleaning part. Namely, in the cleaning tool 21, either of the end part 21*a* or end part 21*b* can be held between the storage part 12 and the pressing part 13 of the holder 10. According to this embodiment of the present invention, the holding part and the cleaning part may be indistinguishable in structure from each other.

In the cleaning tool 21, the individual cord 4 may not be mutually bonded. By having the holding material 5 wound around the bundle of the cords, the shape of the cleaning tool 21 shown in FIG. 3 can be maintained until it is held by the holder 10. When either of the end part 21*a* or end part 21*b* is held between the storage part 12 and the pressing part 13 of the holder 10, the base parts of the cords 4 in the end part held by the storage part 12 and the pressing part 13 are in a state of being bundled. The state of being bundled thereof is maintained even when the holding material 5 gets wet by water and disintegrated thereafter, because the base parts of the cords 4 are held by the storage part 12 and the pressing part 13. Also, when the holding material 5 gets wet by water and disintegrated, the cords 4 in the end part not held by the holder 10 are set in a free state, and it becomes possible to wipe the part to be cleaned with the individual cords 4.

In the cleaning tool 21 shown in FIG. 3, all of the cords 4 may be mutually bonded by the water-soluble adhesive over the whole length thereof. Alternately, the holding material 5 may not be necessary as long as the cords 4 are bonded by the water-soluble adhesive and can maintain the bundled state thereof in dry condition.

Figure 4:
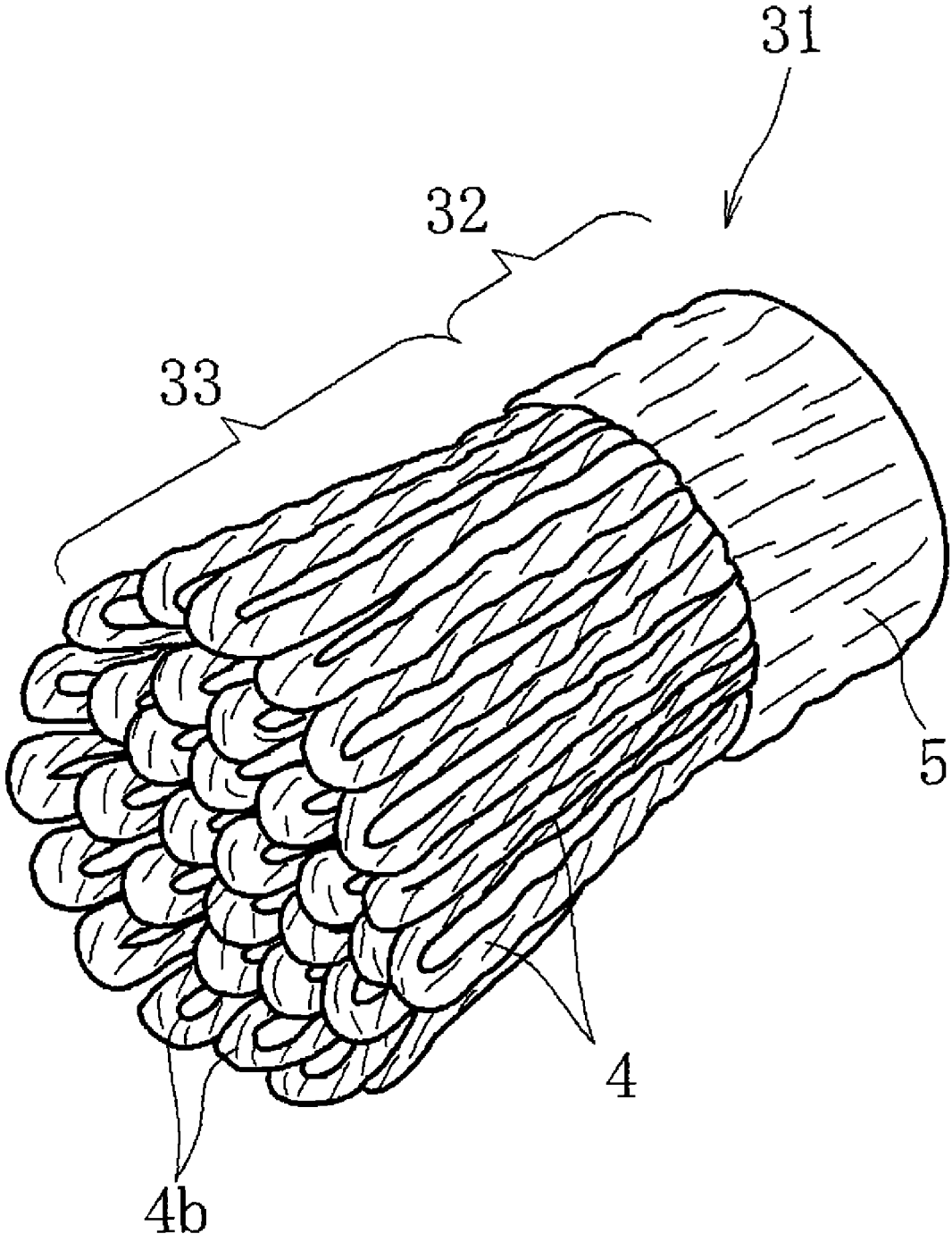
FIG. 4 is a perspective view showing a water-disintegrable cleaning tool according to a third embodiment of the present invention.

In a cleaning tool 31 of a third embodiment shown in FIG. 4, the individual cord 4 is folded back at the middle in a direction of its length, and both of the end parts of the cords 4 are bundled in a holding part 32 and mutually bonded by the water-soluble adhesive. The holding material 5 is wound therearound and bonded thereto. Bent parts 4*b* of the cords 4 are aligned at a tip end of a cleaning part 33, and the cords 4 are positioned independently from one another in the cleaning part 33.

In this cleaning tool 31, the bent parts 4*b* of the cords 4 are positioned in the cleaning part 33. Since both of the end parts of the bent cords 4 are bundled in the holding part 32 and no cut end face 4*a* thereof is exposed in the cleaning part 33, the twist of the each cord 4 is hardly loosened and the rigidity thereof can be maintained relatively longer, even when water is adhered to the tip part of the cleaning part 33 and the bent parts 4*b* get wet. Therefore, the dirt adhered to the surface of the part to be cleaned can be easily removed by rubbing the bent parts 4*b* against the part to be cleaned.

Figure 5:
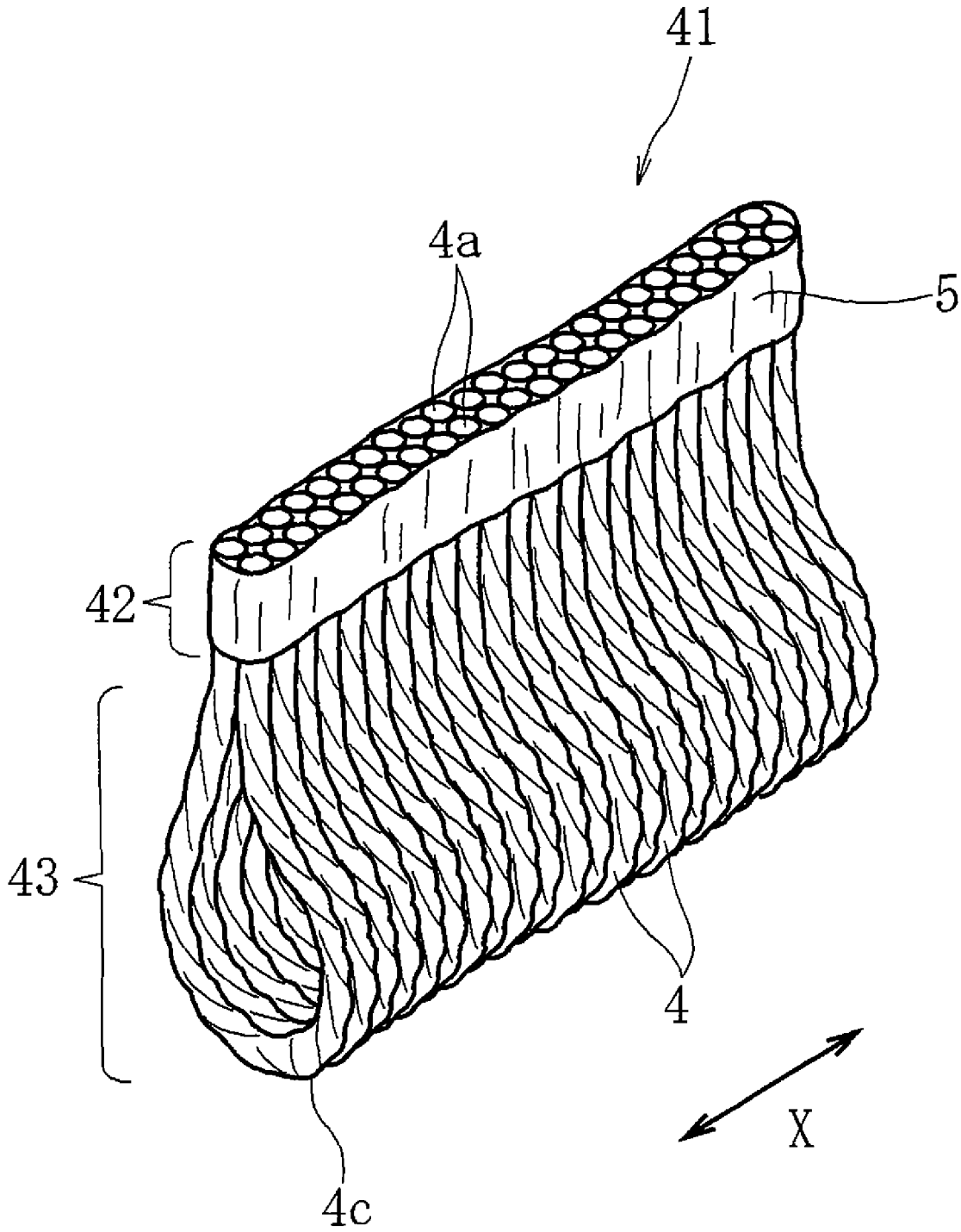
FIG. 5 is a perspective view showing a water-disintegrable cleaning tool according to a fourth embodiment of the present invention.

In a water-disintegrable cleaning tool 41 of a fourth embodiment shown in FIG. 5, the individual cord 4 is bent to form a loop. Both of the end parts of the looped cord 4 are mutually bonded by the water-soluble adhesive with the cut end faces 4*a* thereof being aligned. The holding material 5 is wound around the aligned end parts of the cords 4 and bonded thereto by the water-soluble adhesive to form a holding part 42 in a flat shape. In the cleaning part 43, the individual cord 4 is freely movable. Loop parts 4*c* formed by bending the cords 4 are positioned on the tip part of the cleaning part 43. The holding part 42 of this embodiment may be the one that is formed by pressing or by heating and pressing the cords 4 and the holding material 5 together so that the cords 4 and the holding material 5 can be formed in a flat shape and the respective cords 4 therein are mutually hydrogen-bonded. The holding part 42 of this embodiment may be the one that is not provided with the holding material 5.

In the holder for holding the cleaning tool 41, differently from the case of the holder shown in FIG. 1, the storage part 12 and the pressing part 13 are formed to have planar faces opposed to each other. The holding part 42 of the cleaning tool 41 is sandwiched and held between the planar faces of the storage part 12 and the pressing part 13.

In the cleaning tool 41, the loop parts 4*c* of the cords 4 are positioned in the cleaning part 43. Since both of the end parts of the looped cords 4 are bonded to each other in the holding part 42 and no cut end face 4*a* thereof is exposed in the cleaning part 43, the twist of the each cord 4 is hardly loosened and the rigidity thereof can be maintained relatively longer, even when water is adhered to the tip part of the cleaning part 43 and the loop parts 4*c* get wet. Further, when the loop parts 4*c* are made to slide on the surface of the part to be cleaned in X direction which is an arrangement direction of the loop parts 4*c*, the individual loop parts 4*c* rubs the surface of the part to be cleaned independently, thereby effectively removing the dirt adhered to the surface.

Figure 6:
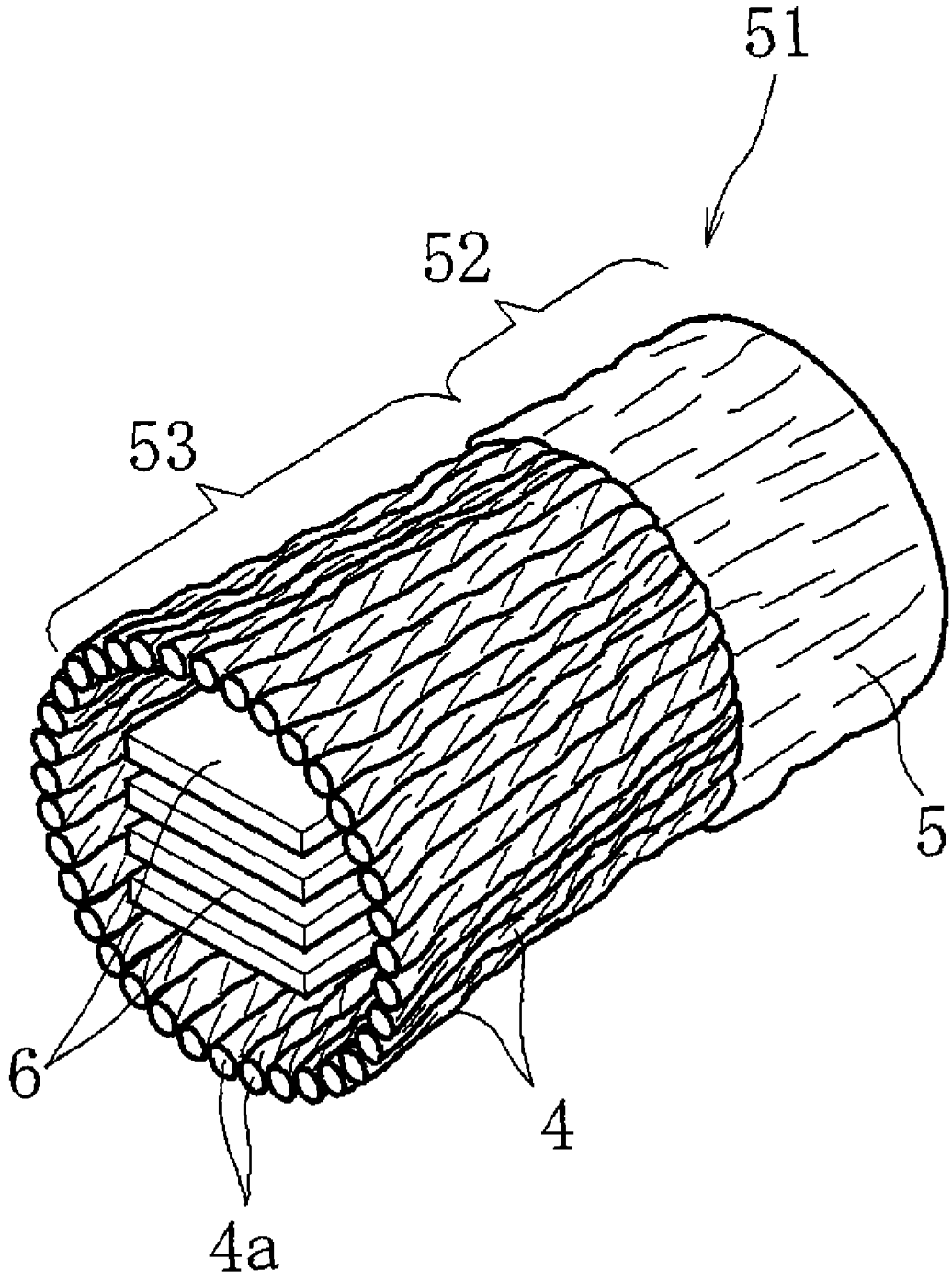
FIG. 6 is a perspective view showing a water-disintegrable cleaning tool according to a fifth embodiment of the present invention.
Figure 7:
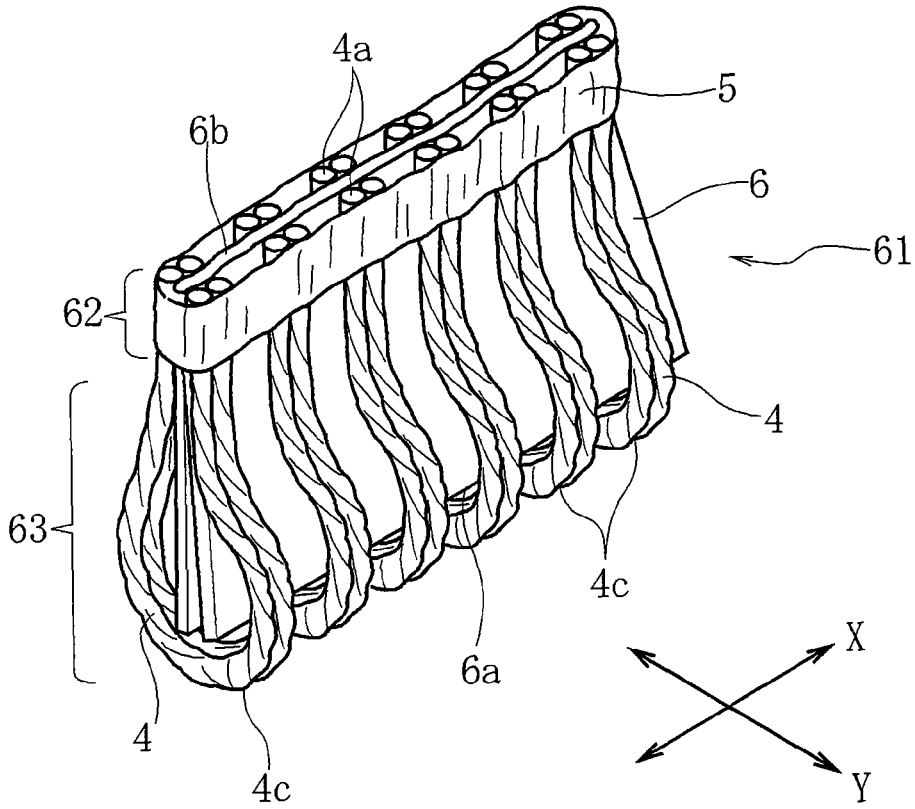
FIG. 7 is a perspective view showing a water-disintegrable cleaning tool according to a sixth embodiment of the present invention.
Figure 8:
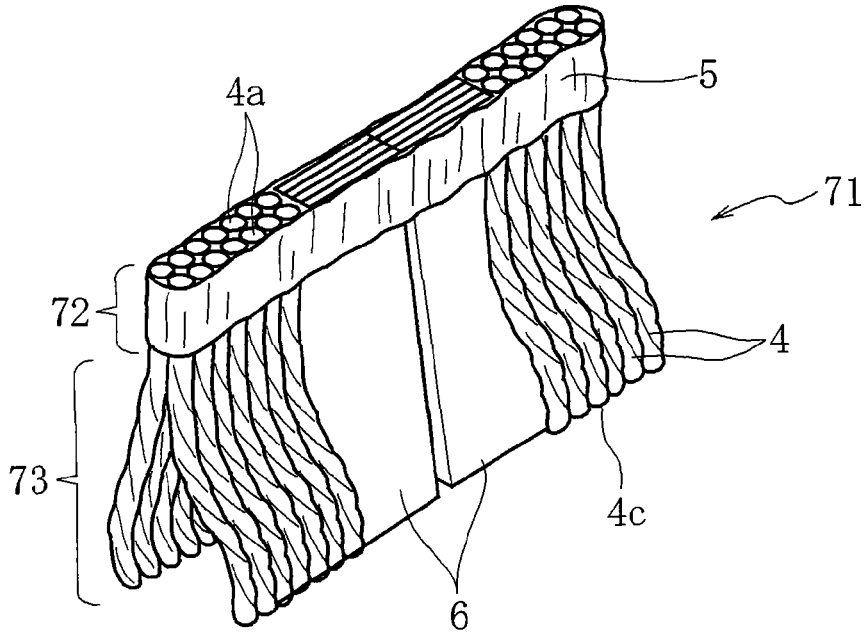
FIG. 8 is a perspective view showing a water-disintegrable cleaning tool according to a seventh embodiment of the present invention.

In the embodiments shown in FIG. 6 to FIG. 8, the cleaning part includes the cords 4 and a water-disintegrable sheet member 6.

The water-disintegrable sheet member 6 is a sheet-shaped water-disintegrable material called a sheet pulp, which is formed by stacking layers of pulp fibers and pressing the layers into a sheet shape. The sheet pulp maintains the sheet shape thereof by the hydrogen bonding of the pulp fibers. Alternately, the pulp fibers may be bonded by the water-soluble adhesive such as PVA. The fabric base weight of the sheet pulp is about 500 to 1000 g/m$^2$, which is sufficiently large compared with the water-disintegrable paper 9 of FIG. 12B, whose fabric base weight is about 10 to 30 g/m$^2$. The water-disintegrable sheet member 6 formed of the sheet pulp thus has a large fabric base weight, high density, and high rigidity. Therefore, the sheet member 6 provided in the cleaning part of the cleaning tool makes it easy to remove the dirt adhered to the part to be cleaned such as the toilet bowl. When the cleaning tool having both of the water-disintegrable sheet member 6 and the cords 4 is used, the cords 4 relatively freely deform to spread over a broad area of the part to be cleaned or to reach corners of the toilet bowl, while the easy dirt removal is secured by the sheet member 6.

Disposed in the flush toilet after use, the sheet pulp is disintegrated into pulp fibers in relatively a short period.

In a water-disintegrable cleaning tool 51 of a fifth embodiment shown in FIG. 6, a plurality of cords 4 are arranged around plural sheet members 6 (for example, about 5 to 20 sheets) stacked on one another. In a holding part 52 of the cleaning tool 51, the sheet members 6 and the cords 4 are bonded to each other by the water-soluble adhesive, and the holding material 5 is wound around the sheet members 6 and the cords 4 and bonded thereto. In a cleaning part 53 of the cleaning tool 51, the individual sheet members 6 can be separated from one another, and further the cords 4 can be separated from one another.

When the cleaning tool 51 is used, the tip part of the cleaning part 53 is pressed against a surface of the part to be cleaned and slid thereon. At this time, the surface is rubbed by the distal end side of the sheet member 6, while the individual cords 4 can spread over a wide area of the surface and reach corners of the toilet bowl, etc. The bent parts 4*b* of the cords 4 shown in FIG. 4 may be provided in the cleaning part 53 of the cleaning tool 51.

A water-disintegrable cleaning tool 61 of a sixth embodiment is provided, as shown in FIG. 7, with one sheet of the water-disintegrable sheet member 6 or plural sheets thereof stacked on one another. The sheet member 6 is formed to have substantially the same size as that of the cleaning tool 61. The plurality of the cords 4 are provided around the sheet member 6. Each of the cords 4 is formed in a loop shape having its loop part 4*c* positioned around a lower side 6*a* of the sheet member 6. The cut end faces 4*a* of the cords 4 are aligned with an upper side 6*b* of the sheet member 6. The cords 4 are bonded to the sheet member 6 with both end parts in vicinity of the cut end faces 4*a* thereof respectively bonded to both side faces of the sheet member 6, and the holding material 5 is wound around the cords 4 and the sheet member 6 and bonded thereto, whereby the holding part 62 is formed in a flat shape. In a cleaning part 63 of the cleaning tool 61, the individual cords 4 can move independently of each other, and can move independently of the sheet member 6. In the holder for holding the cleaning tool 61, differently from the case of the holder shown in FIG. 1, the storage part 12 and the pressing part 13 are formed to have planar faces opposed to each other. The holding part 62 of the cleaning tool 61 is sandwiched and held between the planar faces of the storage part 12 and the pressing part 13.

When the cleaning part 63 of the cleaning tool 61 is made to slide on the surface of the part to be cleaned in Y direction shown in FIG. 7, the lower side 6*a* of the sheet member 6 is rubbed against the surface. Further, when the cleaning part 63 of the cleaning tool 61 is made to slide on the surface in X direction perpendicular to Y direction, the surface can be wiped by the loop parts 4*c* of the cords 4.

A water-disintegrable cleaning tool 71 of a seventh embodiment shown in FIG. 8 includes a plurality of aforementioned rectangular water-disintegrable sheet members 6 stacked on one another, and a plurality of cords 4. The sheet members 6 are arranged at the middle in a width direction of the sheet members 6 and the cords 4 are arranged on outer sides in the width direction of the sheet members 6. The holding material 5 is wound around upper parts of the sheet members 6 and upper parts of the cords 4, to form a holding part 72 in a flat shape. A cleaning part 73 of the cleaning tool 71 is provided with the cords 4 each having downwardly facing cut end faces 4*a*, and the sheet members 6 positioned independently from one another.

The cleaning tool 71 thus formed can also perform the above-mentioned wiping-off operation, using the cords 4 and the water-disintegrable sheet members 6 of sheet pulps. In addition, the cords 4 on outer sides of the sheet members 6 may have the bent parts 4*b* shown in FIG. 4 or the loop parts 4*c* shown in FIG. 5 aligned at the tip part of the cleaning part 73. In the holder for holding the cleaning tool 71, differently from the case of the holder shown in FIG. 1, the storage part 12 and the pressing part 13 are formed to have planar faces opposed to each other. The holding part 72 of the cleaning tool 71 is sandwiched and held between the planar faces of the storage part 12 and the pressing part 13.

Figure 9:
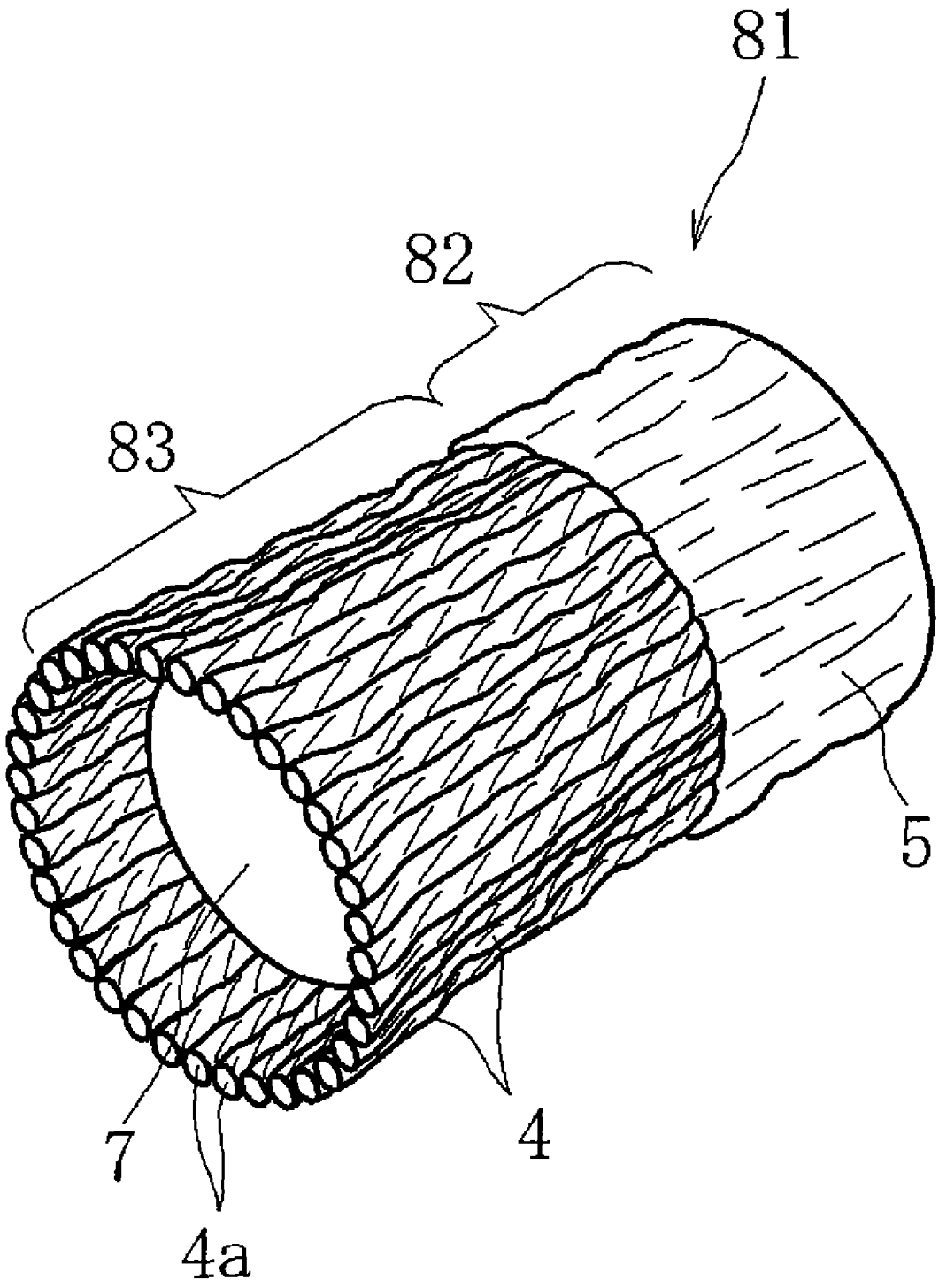
FIG. 9 is a perspective view showing a water-disintegrable cleaning tool according to an eighth embodiment of the present invention.
Figure 11:
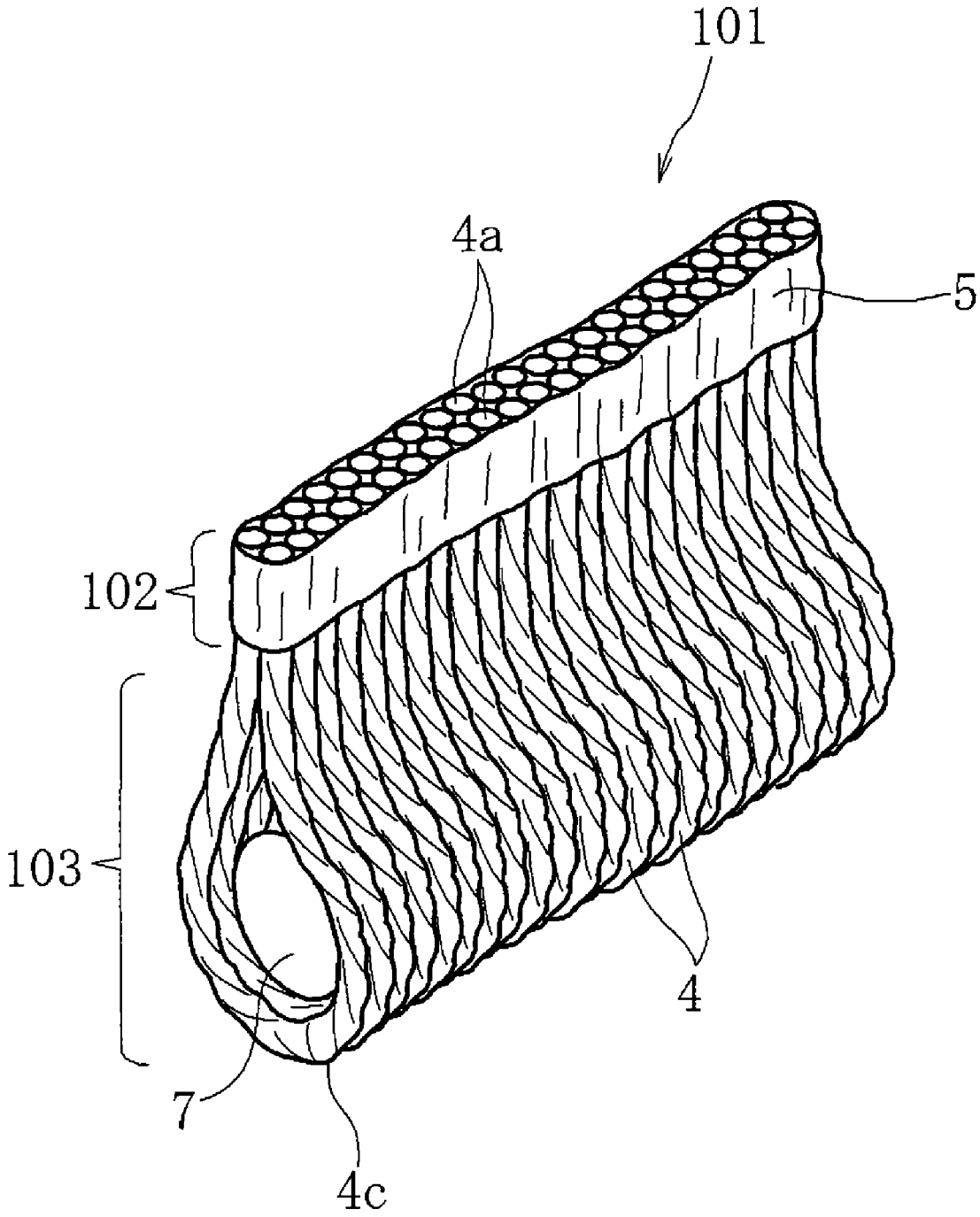
FIG. 11 is a perspective view showing a water-disintegrable cleaning tool according to a tenth embodiment of the present invention.

In the embodiments shown in FIG. 9 and FIG. 11, the cleaning part of the cleaning tool is provided with a water-disintegrable block member 7 and the cords 4.

The water-disintegrable block member 7 is a solid block-shaped water-disintegrable material which is formed of biodegradable fibers dispersible into water such as pulp fibers. A method of manufacturing the block member 7 includes the steps of: dispersing the pulp fibers into water; pouring the water containing the dispersed pulp fibers into a mold in a concave-shape such as a cylindrical shape and the like, having a perforated dewatering screen on a bottom thereof; and dewatering, heating and drying the pulp fibers. Another method of manufacturing the block member 7 includes steps of: pouring the pulp fibers in the aforementioned mold or other shaped press mold; pressing by a press machine after dewatering or during dewatering; and drying the pressed pulp fibers. Still another method of manufacturing the block member 7 includes steps of: discharging a sludge-like raw material obtained by mixing pulp fibers, a thickening agent, and the water-soluble adhesive from a screw extruder; and dewatering, heating and drying the product discharged from the screw extruder.

The water-disintegrable block member 7 is formed in such a way that the pulp fibers or the other fibers are bound by the hydrogen bonding in an aggregated state, or the fibers are bonded by the water-soluble adhesive.

In a cleaning tool 81 of an eighth embodiment shown in FIG. 9, the water-disintegrable block member 7 is used instead of the water-disintegrable sheet member 6 in the cleaning tool 51 shown in FIG. 6. In a holding part 82 of the cleaning tool 81, the block member 7 and the cords 4 are bonded by the water-soluble adhesive, and the holding material 5 is wound therearound and bonded thereto. In a cleaning part 83 of the cleaning tool 81, the cords 4 are provided around the block member 7 in a free state. The cords 4 extend out from the tip of the cleaning part 83 to have the cut end faces 4*a* thereof facing downward.

Figure 10:
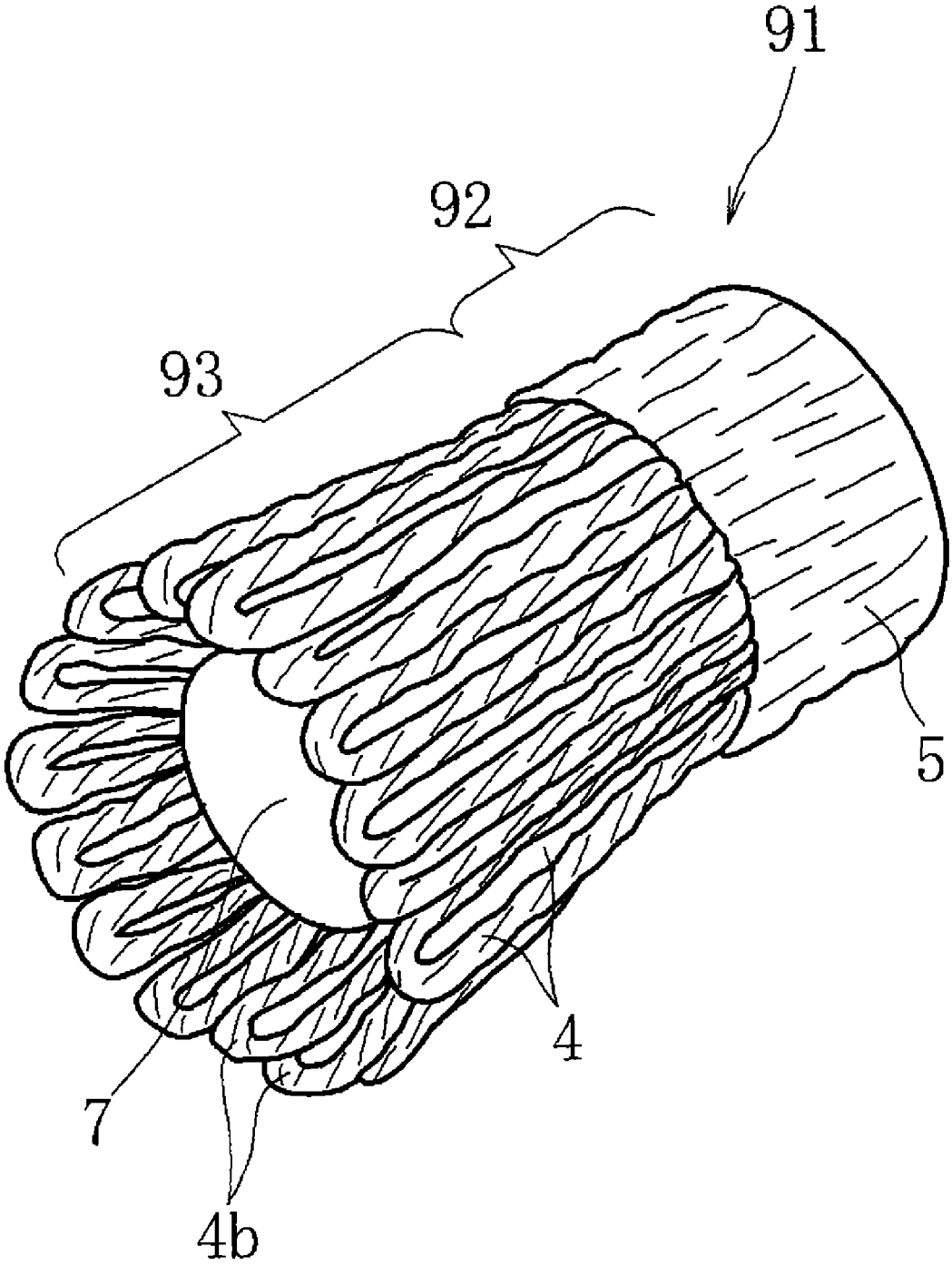
FIG. 10 is a perspective view showing a water-disintegrable cleaning tool according to a ninth embodiment of the present invention.

A cleaning tool 91 of a ninth embodiment shown in FIG. 10 is provided in a cleaning part 93 thereof with the bent cords 4 around the block member 7. The bent parts 4*b* of the cords 4 are aligned in a position at the tip of the cleaning part 93. In a holding part 92 of the cleaning tool 91, the block member 7 and the base part of the cords 4 are bonded by the water-soluble adhesive, and the holding material 5 is wound therearound and bonded thereto.

In the cleaning tool 81 shown in FIG. 9 and the cleaning tool 91 shown in FIG. 10, the end face of the block member 7 is exposed on the tip part of the cleaning parts 83 and 93. Therefore, when the cleaning tool 81 or 91 is used, the end face of the high rigidity block member 7 is rubbed against the part to be cleaned, whereby a dirt removing effect of the tool can be enhanced. In addition, broader area of a surface to be cleaned can be wiped off by the cords 4 provided around the block member 7. After the cleaning tool is used and disposed in the flush toilet, binding of the holding parts 82 and 92 is removed, and the block member 7 and the cords 4 are disintegrated into pieces. Then, given a large quantity of water, the cords 4 and the block member 7 are further disintegrated in the water in a short period with the fibers thereof dispersed.

A cleaning tool 101 of a tenth embodiment shown in FIG. 11 includes a cylindrical water-disintegrable block member 7 inserted through the loops formed by the looped cords 4 in the cleaning tool 41 shown in FIG. 5. The block member 7 and each cord 4 are bonded together by the water-soluble adhesive. In a holding part 102 of the cleaning tool 101, the base parts of the cords 4 are bonded by the water-soluble adhesive, and the holding material 5 is wound therearound and bonded thereto by the water-soluble adhesive. A cleaning part 103 of the cleaning tool 101 is constituted by the block member 7 and the cords 4 bonded to the block member 7. In the holder for holding the cleaning tool 101, differently from the case of the holder shown in FIG. 1, the storage part 12 and the pressing part 13 are formed to have planar faces opposed to each other. The holding part 102 of the cleaning tool 101 is sandwiched and held between the planar faces of the storage part 12 and the pressing part 13.

In the cleaning tool 101, the block member 7 serves as a core member to support the cords 4, when the loop parts 4*c* of the cords 4 are pressed against the part to be cleaned and slid thereon for cleaning. Therefore, it becomes possible to firmly press the loop parts 4*c* of the cords 4 against the part to be cleaned, thereby effectively removing the dirt.

EXAMPLES

Several kinds of the cords 4 of the aforementioned embodiments were tested, and strength and water disintegration time thereof were measured.

As shown in FIG. 13, the cords of examples 1 to 6 were tested. The water-disintegrable sheet constituting the cords of the examples 1 to 6 is formed of bleached softwood kraft pulp (NBKP) and viscose rayon having a denier of 1.1 dtex and 7 mm fiber lengths. A blending ratio (mass %) of the NBKP and the viscose rayon is shown in the table of FIG. 13. The blending ratio of the NBKP was set to 95 mass % in the example 1, 90 mass % in the example 2, 50 mass % in the example 3, 10 mass % in the example 4, 5 mass % in the example 5, and 50 mass % in the example 6. The rest of the blend was made up of the viscose rayon. The fabric base weights of the examples 1 to 6 were all set at 50 g/m$^2$.

The water-disintegrable sheets of the examples 1 to 6 were all manufactured by a wet papermaking process. The water-disintegrable sheets of the examples 1 to 5 were subjected to a water-jet processing thereafter to be the fiber entangled nonwoven fabric. In the example 6, the water-disintegrable paper to which the water-jet processing was not applied was used.

In the water-jet processing, a jet water stream was applied to a layer of fiber web of each example 1 to 5 formed on a plastic wire screen by papermaking, using a high-pressure water-jet machine, without applying a drying treatment to the webs. The high pressure water-jet machine has 2000 nozzles arranged at a pitch of 0.5 mm in a direction perpendicular to a direction of web travel. Each of the nozzles has an opening diameter of 95 μm. A water-jet processing energy of 0.24682 kW/m$^2$ per unit area was given to the fiber web being transferred at a speed of 30 m/min by the high-pressure water-jet machine. Further, the web was subjected to a second water-jet processing under the same condition, and thereafter dried by a Yankee drying drum. Note that in the example 6, the web was dried by the Yankee drying drum without the water jet processing being applied.

The thickness and fiber density of the water-disintegrable sheet thus obtained are shown in the column of "values of physical properties of water-disintegrable sheet" and the columns of "thickness" and "density" in the table of FIG. 13.

The water-disintegrable sheets of the examples 1 to 6 were cut into samples having a length in the direction of web travel through manufacturing (MD) of 150 mm and a width in the direction (CD) perpendicular to the direction of web travel of 25 mm, and a dry strength and a wet strength thereof were measured. This measurement was performed in such a way that each sample was held between chucks of the tensile test device 100 mm apart in a longitudinal direction of the sample, and a tensile test was performed by moving the chucks apart from each other at a speed of 100 mm/min. A maximum load at which the sample of the sheet breaks was set to a breaking strength (N/25 mm) of the tested sheet.

The dry strength is a result of the tensile test performed on each sample in a dry condition. The wet strength is a result of the tensile test performed on each sample after being immersed in the ion exchange water for 10 seconds. This test was performed under an environment of a room temperature of 25° C. and a relative humidity of 65%. In the table of FIG. 13, measurement values are shown in the column of "values of physical properties of water-disintegrable sheet" and the columns of "dry strength" and "wet strength".

Next, each water-disintegrable sheet of the examples 1 to 4 was cut into a strip shape having the width in CD of 50 mm, and twisted in one direction as shown in FIG. 12A to form a twisted cord 4A. The number of twist is set to 17 times per 25 cm unit length of the water-disintegrable sheet before twisting. The width dimensions and densities of the twisted cords are shown in the rows of "cord width" and "density" in the column of "values of physical properties after twisting". In the same way as the measurement of the water-disintegrable sheet, the twisted cords were held between chucks 100 mm apart, the tensile test was performed under the same condition as that of the water-disintegrable sheet, and the breaking strength was measured.

Note that the tensile test was performed for obtaining the wet strength of each sample. The sample was immersed in the ion exchange water for 10 seconds before the test, while being held between chucks to avoid loosening the twist of the cord. The test results are shown in the column of "values of physical properties after twisting" and the columns of "dry strength" and "wet strength".

A water-disintegrability was measured by the same measurement method as described in the explanations of the embodiments. Each water-disintegrable sheet of the examples 1 to 6 was cut into a size of 100 mm×100 mm, and the sheet thus cut was used to measure the water disintegration time. Each cord of examples 1 to 4 was cut into the length of 100 mm, and the cord thus cut was also used to measure the water disintegration time. The measurement results are shown in the row of "disintegrable property" of the table of FIG. 13.

The water-disintegrable sheets of the examples 2 to 4 of FIG. 13 have the dry strengths of 7N/25 mm or more, and they can be easily processed by twisting without causing any cut or breakage. The twisted cords of the examples 2 to 4 have large wet strengths of 8N or more, and the water disintegration time thereof were 123 seconds at maximum. In order to obtain dry strength of 7N/25 mm or more of the water-disintegrable sheet of the example 2 to 4, it is preferable to contain 10 mass % or more of the pulp fibers. In order to obtain the wet strength of 8N or more of the twisted cord of the example 2 to 4, it is preferable to contain 10 mass % or more of the viscose rayon fibers.

The water-disintegrable sheets of examples A to F of FIG. 14 are made in a way that the fiber webs containing 50 mass % of the NBKP and 50 mass % of viscose rayon fibers (a denier of 1.1 dtex and 7 mm fiber length) were formed by a wet papermaking process, and the fiber webs were applied to a water-jet processing thereafter under the same condition as that of the examples 1 to 5. The fabric base weights of the examples A to F are respectively set to "15.0", "20.0", "50.0", "100.0", "120.0", "50.0" (g/m$^2$). The thickness and densities of the water-disintegrable sheets of the examples A to F are shown in the rows of "thickness" and "density" of the column of "values of physical properties of water-disintegrable sheet" in the table of FIG. 14. Then, the dry strength and the wet strength, and the water disintegration time of each water-disintegrable sheet of the example A to F were measured in the same way as that of the example 1 to 6. The results are shown in the columns of the "dry strength" and "wet strength" and "water-disintegrability" in the column of the "values of physical properties of the water-disintegrable sheet".

Further, each of the water-disintegrable sheets of the examples A to F was twisted to form a twisted cord as shown in FIG. 12A. The width dimension of the sheet to be twisted was set at 50 mm. The numbers of twist per unit length 25 cm of the sheet were differentiated for every example, and set at "18", "18", "17", "16", and "4" (times) in the example A to example F, respectively. The width dimensions and densities of the twisted cords are shown in the rows of "cord width" and "density" in the column of the "values of physical properties after twisting". In addition, the dry strengths, the wet strengths and the water disintegration times were measured in the same way as that of the examples 1 to 4. The results were shown in the rows of the "dry strength", "wet strength", and "water-disintegrability" of the column of the "values of physical properties after twisting" in FIG. 14.

It is preferable as shown in FIG. 14 to set the fabric base weight of the water-disintegrable sheet at 30 g/m$^2$ or more, in order to maintain high dry strength of the water-disintegrable sheet and high wet strength of the twisted cord. It is preferable to set the fabric base weight of the water-disintegrable sheet at 120 g/m$^2$ or less, in order to set the water disintegration time at 700 seconds or less. The wet strength of the twisted cord can be increased in the case that the number of twist is 4 times or more, preferably 10 times, per unit length 25 cm of the water-disintegrable sheet. An upper limit of the number of twist is not particularly limited as long as the sheet is not cut, however, the upper limit will be about 30 times.

The preferred embodiments described herein are illustrative and not restrictive, and the invention may be practiced or embodied in other ways without departing from the spirit or essential character thereof. The scope of the invention being indicated by the claims, and all variations which come within the meaning of claims are intended to be embraced herein.

What is claimed is:

1. A water-disintegrable cleaning tool, comprising:

a cleaning part formed of a plurality of cords each formed by twisting a strip of a water-disintegrable sheet; and a holding part which holds the cleaning part, the holding part comprising a holding material wound around an outer peripheral surface of a bundle formed by base parts of the plurality of cords, wherein:

the plurality of cords are fixed to one another and to the holding material by a water-soluble adhesive in the holding part and positioned independently from one another in the cleaning part, and each of the cords has a free end positioned in the cleaning part.

2. The water-disintegrable cleaning tool according to claim 1, wherein the holding part is releasably held by a holder.

3. The water-disintegrable cleaning tool according to claim 1, wherein each of the cords is bent to have its bent part positioned in the cleaning part.

4. The water-disintegrable cleaning tool according to claim 1, further comprising: any one of a sheet-shaped water-disintegrable material and a block-shaped water-disintegrable material provided in the cleaning part.

5. The water-disintegrable cleaning tool according to claim 1, wherein the base parts of individual cords have a cylindrical shape and are bundled in the holding part.

6. The water-disintegrable cleaning tool according to claim 1, wherein the water-disintegrable sheet is formed as a fiber entangled nonwoven fabric in which fibers having fiber lengths of 20 mm or less are entangled.

7. The water-disintegrable cleaning tool according to claim 6, wherein the water-disintegrable sheet comprises a water-disintegrable paper including only pulp fibers joined together by the hydrogen bonding force.

8. The water-disintegrable cleaning tool according to claim 6, wherein the water-disintegrable sheet comprises a water-disintegrable paper including pulp fibers and rayon fibers joined together by the hydrogen bonding force.

9. The water-disintegrable cleaning tool according to claim 6, wherein the fibers are joined together by water-soluble binder.

10. The water-disintegrable cleaning tool according to claim 9, wherein the water-soluble binder is applied over each of the twisted strips forming the plurality of cords.

* * * * *